US008209806B2

(12) United States Patent
Lyons

(10) Patent No.: US 8,209,806 B2
(45) Date of Patent: Jul. 3, 2012

(54) GUIDED POOL BRUSH

(76) Inventor: Leon Lyons, Scottsdale, AZ (US)

( * ) Notice: Subject to any disclaimer, the term of this patent is extended or adjusted under 35 U.S.C. 154(b) by 922 days.

(21) Appl. No.: 12/177,555

(22) Filed: Jul. 22, 2008

(65) Prior Publication Data

US 2010/0017987 A1 Jan. 28, 2010

(51) Int. Cl.
*E04H 4/16* (2006.01)

(52) U.S. Cl. ..... 15/1.7

(58) Field of Classification Search ..... 4/490, 496; D04/118, 135; 15/1.7, 160, 159.1, 171; 210/167.16, 210/167.17; 134/172, 198; 68/227; *E04H 4/16*
See application file for complete search history.

(56) References Cited

U.S. PATENT DOCUMENTS

| | | | | | |
|---|---|---|---|---|---|
| 2,243,576 | A | | 5/1941 | Otto | |
| 2,769,549 | A | * | 11/1956 | Bixby | 15/1.7 |
| 2,814,066 | A | * | 11/1957 | Lesh, Jr. | 15/365 |
| 2,899,063 | A | * | 8/1959 | Ellis, Jr. | 210/167.21 |
| 3,003,168 | A | | 10/1961 | Shouldice | |
| 3,402,413 | A | * | 9/1968 | Gibellina | 15/1.7 |
| 4,037,285 | A | * | 7/1977 | Bottos | 15/160 |
| 4,486,913 | A | * | 12/1984 | Kubick | 15/159.1 |
| 4,637,087 | A | | 1/1987 | Feinberg | |
| 4,733,427 | A | | 3/1988 | Conrad | |
| 4,783,868 | A | | 11/1988 | O'Callaghan | |
| 4,909,173 | A | | 3/1990 | Strong | |
| D351,948 | S | * | 11/1994 | Getchell | D4/132 |
| 5,487,397 | A | * | 1/1996 | Bean | 134/6 |
| 5,539,947 | A | | 7/1996 | Kiraly | |
| 5,864,917 | A | | 2/1999 | Landsman | |
| D414,342 | S | * | 9/1999 | Ancona et al. | D4/119 |
| 5,983,431 | A | * | 11/1999 | Meshulam | 15/1.7 |
| 6,301,737 | B1 | * | 10/2001 | Morse | 15/1.7 |
| 6,668,413 | B2 | * | 12/2003 | Fortier | 15/1.7 |
| 7,039,979 | B2 | * | 5/2006 | McFarland | 15/1.7 |
| 7,353,559 | B1 | * | 4/2008 | Blackwell | 15/1.7 |
| 7,409,740 | B1 | * | 8/2008 | Geigan | 15/1.7 |
| 7,506,393 | B1 | * | 3/2009 | LeClair | 15/1.7 |
| 2002/0083536 | A1 | * | 7/2002 | Holiday | 15/1.7 |
| 2003/0150072 | A1 | | 8/2003 | Pong | |
| 2004/0060129 | A1 | * | 4/2004 | Juett | 15/1.7 |
| 2004/0255427 | A1 | * | 12/2004 | Gavney, Jr. | 15/401 |
| 2007/0192969 | A1 | * | 8/2007 | Butler et al. | 15/1.7 |
| 2010/0275367 | A1 | * | 11/2010 | Bager et al. | 4/628 |

* cited by examiner

*Primary Examiner* — Joseph J Hail
*Assistant Examiner* — Tyrone V Hall, Jr.
(74) *Attorney, Agent, or Firm* — Booth Udall, PLC

(57) ABSTRACT

A guided pool brush and pool cleaning method are described. A guided pool brush may comprise a guiding member and a brush. The guiding member may comprise at least one of a front concave downforce portion, a rear concave downforce portion, a rear concave upforce portion, and a rear flat upforce portion. A pool cleaning method may include pushing a guided pool brush alternately in a backward movement and a forward movement proximate a pool surface, the forces on the guiding member causing the guided pool brush to maintain on the pool surface during the forward movement and at least one of maintain on the pool surface or maintain slightly above the pool surface during the backward movement. The guided pool brush may allow a user to more easily and/or more effectively clean a pool surface by ensuring proper contact of the brush with the pool surface when desired.

20 Claims, 4 Drawing Sheets

GUIDED POOL BRUSH

BACKGROUND

1. Technical Field

Aspects of this document relate generally to pool cleaning apparatuses. Aspects relate more specifically to implementations of pool brushes for cleaning a pool surface.

2. Background Art

Pools generally require maintenance to ensure that the pool surfaces remain clean. In the past, pool cleaning apparatuses used for such maintenance have been difficult to use because of the hydrodynamic forces imposed on the pool cleaning apparatuses during use. For instance some pool cleaning apparatuses have been difficult to use because, during forward or backward movement of the apparatus, they tended to pull off of the pool surface, and thus the user had to exert more force to not only move the brush forward or backward but also to push the brush against the pool surface.

SUMMARY

In an aspect, this document features a guided pool brush, comprising: a brush; and a guiding member coupled to or integrally joined with the brush, the guiding member comprising: a front concave downforce portion at a front topside of the guiding member, configured to produce a first force on the guided pool brush, at least a portion of the first force being substantially directed towards the pool surface, in response to a forward movement of the guided pool brush; a rear concave downforce portion at a rear topside of the guiding member, configured to produce a second force on the guided pool brush, at least a portion of the second force being substantially directed towards the pool surface, in response to a backward movement of the guided pool brush; and a rear concave upforce portion at a rear underside of the guiding member, configured to produce a third force on the guided pool brush, at least a portion of the third force being substantially directed away from the pool surface, in response to the backward movement of the guided pool brush.

Implementations may include one or more of the following.

The front concave downforce portion may comprise a radius between about ¾ inch and about 1¾ inches. The front concave downforce portion may comprise a radius of about 1¼ inches. The rear concave downforce portion may comprise a radius between about 1 inch and about 2 inches. The rear concave downforce portion may comprise a radius of about 1½ inches. The rear concave upforce portion may comprise a radius between about 2 inches and about 3 inches. The rear concave upforce portion may comprise a radius of about 2½ inches. The guiding member may further comprise: a front flat brush interface portion at a front underside of the guiding member; and a rear flat upforce portion between the front flat brush interface portion and the rear concave upforce portion, configured to produce a fourth force on the guided pool brush, at least a portion of the fourth force being substantially directed away from the pool surface, in response to the backward movement of the guided pool brush. The guiding member may further comprise a front convex bullnose portion at a frontside of the guiding member. The front convex bullnose portion may comprise a radius between about ¼ inch and about ¾ inch. The front convex bullnose portion may comprise a radius of about ½ inch.

In another aspect, this document features a guided pool brush, comprising: a brush; and a guiding member coupled to or integrally joined with the brush, comprising: a front concave downforce portion at a front topside of the guiding member, configured to produce a first force on the guided pool brush, at least a portion of which is substantially directed towards the pool surface, in response to a forward movement of the guided pool brush; a rear concave downforce portion at a rear topside of the guiding member, configured to produce a second force on the guided pool brush, at least a portion of which is substantially directed towards the pool surface, in response to a backward movement of the guided pool brush; and a rear flat upforce portion at a rear underside of the guiding member, configured to produce a fourth force on the guided pool brush, at least a portion of which is substantially directed away from the pool surface, in response to the backward movement of the guided pool brush.

Implementations may include one or more of the following.

The front concave downforce portion may comprise a radius between about 1 inch and about 2 inches. The front concave downforce portion may comprise a radius of about 1½ inches. The rear concave downforce portion may comprise a radius between about 1 inch and about 2 inches. The rear concave downforce portion may comprise a radius of about 1½ inches. The guiding member may further comprise a front convex bullnose portion at a frontside of the guiding member. The guiding member may further comprise a top convex bullnose portion at a topside of the guiding member, the top convex bullnose portion comprising a radius between about 1/16 inch and about ½ inch.

In another aspect, this document features a method of cleaning a pool surface, comprising: pushing a guided pool brush forward proximate a pool surface; producing a first force on the guided pool brush at a front concave downforce portion at a front topside of a guiding member of the guided pool brush in response to the forward movement of the guided pool brush, at least a portion of the first force being substantially directed towards the pool surface, thereby maintaining a brush of the guided pool brush against the pool surface with a first pressure in response to the first force; pulling the guided pool brush backward proximate the pool surface; producing a second force on the guided pool brush at a rear concave downforce portion at a rear topside of the guiding member of the guided pool brush in response to the backward movement of the guided pool brush, at least a portion of the second force being substantially directed towards the pool surface; producing a fourth force on the guided pool brush at a rear flat upforce portion at a rear underside of the guiding member of the guided pool brush in response to the backward movement of the guided pool brush, at least a portion of the fourth force being substantially directed away from the pool surface; and maintaining the brush of the guided pool brush at least one of: above the pool surface; and against the pool surface with a second pressure in response to the second force and the fourth force, the second pressure being one of less than the first pressure and equal to the first pressure.

Implementations may include one or more of the following.

The method may further comprise the step of producing a third force on the guided pool brush at a rear concave upforce portion at a rear underside of the guiding member of the guided pool brush in response to the backward movement of the guided pool brush, at least a portion of the third force being substantially directed away from the pool surface; and wherein the step of maintaining the brush of the guided pool brush against the pool surface with a second pressure comprises maintaining the brush of the guided pool brush against the pool surface with a second pressure in response to the second force, the third force, and the fourth force, the second pressure being one of less than the first pressure and equal to the first pressure.

These and other implementations may have one or more of the following advantages. The disclosed guided pool brushes and the disclosed methods of cleaning a pool surface may allow a person to use less effort to clean a pool. They may also allow a person to have less negative effects than would be experienced with other pool brushes, such as sore and aching muscles and fatigue. They may also allow a person to clean a pool in less time as the guided pool brush may remove more algae, debris, contaminant, sediment, waste, or other accumulation per brush stroke. They may also allow a person to get a pool surface cleaner than can be accomplished with other pool brushes. They may also enable a person to maintain a pool cleaner over time as the brush strokes with the guided pool brush may brush deeper than other pool brushes and therefore may more effectively prevent algae, debris, contaminants, sediment, waste, and other accumulation from building up on the pool surface.

These general and specific aspects may be implemented using a system, a method, or any combination of systems and/or methods. Additionally, the foregoing and other aspects, features, and advantages will be apparent from the DESCRIPTION and DRAWINGS, and from the CLAIMS.

BRIEF DESCRIPTION OF THE DRAWINGS

Implementations will hereinafter be described in conjunction with the appended DRAWINGS, where like designations denote like elements, and.

DESCRIPTION

Terminology and Definitions

Figure 1A:
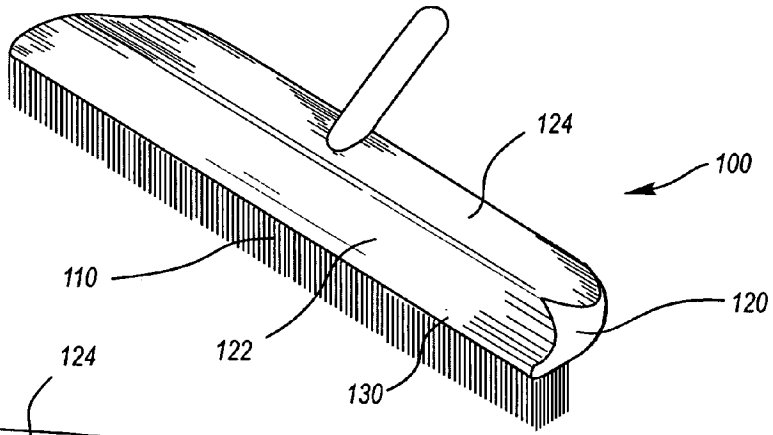
FIG. 1A is a perspective view of an implementation of a guided pool brush.
Figure 1B:
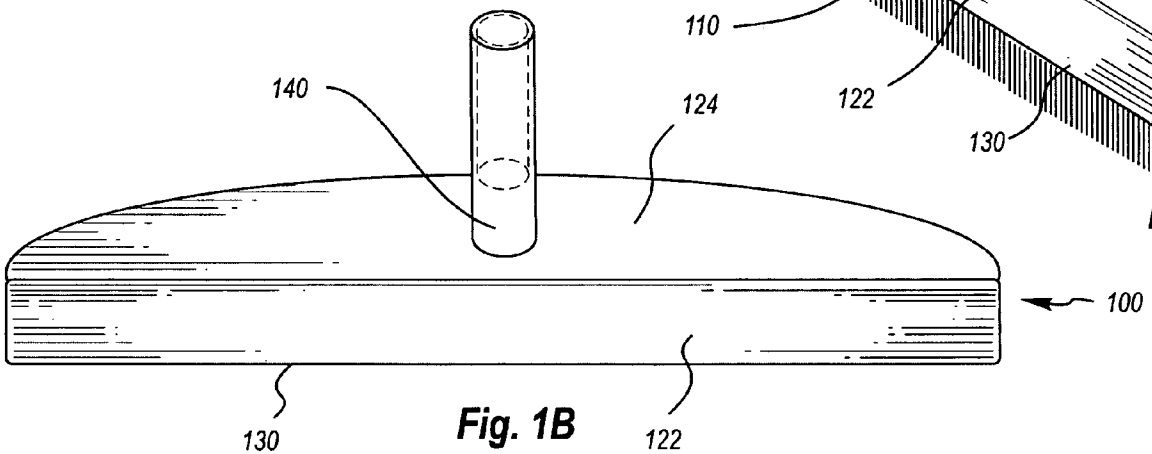
FIG. 1B is a top view of the guided pool brush in FIG. 1A.
Figure 1C:
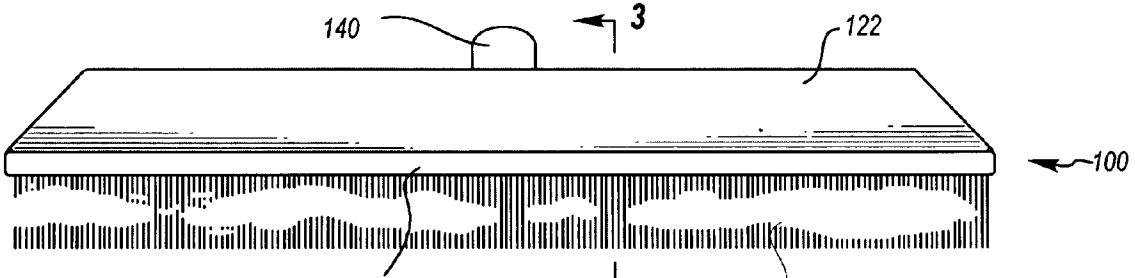
FIG. 1C is a front view of the guided pool brush in FIG. 1A.

In describing various implementations, the following terminology will be used in accordance with the definitions and explanations set out below. Notwithstanding, other terminology, definitions, and explanations may be found throughout this document as well.

"Forward movement" of the guided pool brush is herein defined as movement away from the user. For instance when the guided pool brush is on the bottom of the pool forward movement of the guided pool brush would comprise moving the guided pool brush away from the user. If the guided pool brush is on the side of the pool forward movement would comprise moving the guided pool brush downward away from the user.

"Backward movement" of the guided pool brush is herein defined as movement towards the user. For instance when the guided pool brush is on the bottom of the pool backward movement of the guided pool brush would comprise moving the guided pool brush towards the user. If the guided pool brush is on the side of a pool backward movement of the guided pool brush would comprise moving the guided pool brush upwards towards the user.

"Pool surface," "surface of a pool," and other similar phrases are herein defined as any underwater surface of a pool, including the bottom of the pool, the sides of the pool, the top of a step or recessed or raised portion of a pool, the side of a step or recessed or raised portion of a pool, the underside or bottom of a step or recessed or raised portion of a pool, and so forth. The pool surface can comprise any material or combination of materials such as cement, quartz, marble, plaster, grout, river rock, pebbles, ceramic tiles, seashells, and so forth. The pool surface can also comprise any texture and roughness. For instance the roughness of the pool surface could range anywhere from completely smooth to extremely rough The terms "rear" and "rearside," when used in the context of describing the guiding member, refer to a portion of the guiding member that is nearer to the user than the "front" or "frontside" of the guiding member during use. The terms "front" and "frontside," when used in the context of describing the guiding member, refer to a portion of the guiding member that is farther from the user than the "rear" or "rearside" of the guiding member during use. The terms "top" and "topside," when used in the context of describing the guiding member, refer to a portion of the guiding member that is farther from the pool surface than the "bottom," "bottomside," or "underside" of the guiding member during use. The terms "bottom," "bottomside," and "underside," when used in the context of describing the guiding member, refer to a portion of the guiding member that is nearer to the pool surface than the "top" or "topside" of the guiding member during use. The terms "bottom," "bottomside," and "underside," when used in the context of describing the guiding member, refer to a portion of the guiding member that is nearer to the pool surface than the "top" or "topside" during use. Any of these terms used to describe any of the various elements or subcomponents of the guiding member have the same general connotation.

The terms "rear" and "rearside," when used in the context of describing the brush of the guided pool brush, refer to a portion of the brush that is nearest to the user during use. The terms "front" and "frontside," when used in the context of describing the brush of the guided pool brush, refer to a portion of the brush that is farthest from the user during use. The terms "top" and "topside," when used in the context of describing the brush of the guided pool brush, refer to a portion of the brush that is farthest from the pool surface during use. The terms "bottom," "bottomside," and "underside" when used in the context of describing the brush of the guided pool brush, refer to a portion of the brush that is nearest to the pool surface, and is meant to contact the pool surface, during use.

Structure

Guiding Member

The guiding member is coupled to or integrally joined with the brush. The guiding member may comprise at least one of a front concave downforce portion, a front flat brush interface portion, a front convex bullnose portion, a top convex bullnose portion, a rear concave downforce portion, a rear tail portion, a rear convex bullnose portion, a rear concave upforce portion, and a rear flat upforce portion.

Front Concave Downforce Portion

In embodiments utilizing a front concave downforce portion the front concave downforce portion is at a front topside of the guiding member. The front concave downforce portion is configured to produce a first force on the guided pool brush, at least a portion of which is substantially directed towards the pool surface, in response to a forward movement of the guided pool brush. On the bottom of a pool the first force tends to push the brush of the guided pool brush downward towards the bottom of the pool. On the sides of the pool the first force tends to push the brush of the guided pool brush against the side of the pool. The first force enables and/or enhances proper brushing by allowing the brush to substantially contact and brush against the pool surface during forward movement of the guided pool brush.

The front concave downforce portion comprises a concave shape. However the front concave downforce portion may further comprise other shape characteristics within the concavity or on the edges of the front concave downforce portion such as waviness, irregularities, patterns, bumps, ridges, raised portions, holes, jagged edges, straight edges, uneven edges, and anything else that may aid in producing the second force. The front concave downforce portion may also comprise any of the aforementioned elements in order to achieve other results, such as holes or specific shapes used to reduce drag on the guided pool brush as it moves through the water.

The front concave downforce portion may comprise any material or combination of materials including for example metal, polymer, ceramic, composite, wood, and so forth. The solidness of the front downforce portion may range anywhere from completely solid to substantially hollow. The size of the front downforce portion also may vary in order to fit to any size of brush. The front concave downforce portion, brush, and any other elements or components could be fabricated together such that they are substantially one piece or such that they are multiple pieces that are joined during fabrication. In embodiments where the front concave downforce portion is manufactured as a separate piece from the brush and/or other elements, the front concave upforce portion may be coupled to or integrally joined with the brush and/or the other elements in any manner.

Rear Concave Downforce Portion

In embodiments utilizing a rear concave downforce portion, the rear concave downforce portion is at a rear topside of the guiding member. The rear concave downforce portion is configured to produce a second force on the guided pool brush, at least a portion of which is substantially directed towards the pool surface, in response to a backward movement of the guided pool brush. On the bottom of a pool the second force tends to push the brush of the guided pool brush downward towards the bottom of the pool. On the sides of the pool the second force tends to push the brush of the guided pool brush against the side of the pool. The second force may enable and/or enhance proper brushing by allowing the brush to substantially contact and brush against the pool surface during backward movement of the guided pool brush. However, the second force may also be used in conjunction with a third force and/or a fourth force that to some degree neutralize(s) the second force in order to allow easy backward movement of the guided pool brush, as will be described below.

The rear concave downforce portion comprises a concave shape. However the rear concave downforce portion may further comprise other shape characteristics within the concavity or on the edges of the rear concave downforce portion such as waviness, irregularities, patterns, bumps, ridges, raised portions, holes, jagged edges, straight edges, uneven edges, and anything else that may aid in producing the second force. The rear concave downforce portion may also comprise any of the aforementioned elements in order to achieve other results, such as holes or specific shapes used to reduce drag on the guided pool brush as it moves through the water.

The rear concave downforce portion may comprise any material or combination of materials including for example metal, polymer, ceramic, composite, wood, and so forth. The solidness of the rear concave downforce portion may range anywhere from completely solid to substantially hollow. The size of the rear concave downforce portion also may vary in order to fit to any size of brush. The rear concave downforce portion, brush, and any other elements or components could be fabricated together such that they are substantially one piece or such that they are multiple pieces that are joined during fabrication. In embodiments where the rear concave downforce portion is manufactured as a separate piece from the brush and/or other elements, the rear concave downforce portion may be coupled to or integrally joined with the brush and/or the other elements in any manner.

The first force and second force can be substantially equivalent or they can be entirely different values. As an example, suppose that during backward movement the brush tends to lift away from the pool surface, while during forward movement the brush tends to push downward towards the pool surface with a weak force. In such a scenario it may be desirable to make the second force greater than the first force so as to compensate for the greater lack of downward force during backward movement.

The first force and second forces can comprise substantially similar directional vectors or they can comprise somewhat different directional vectors although still both tending to push the brush in a direction substantially towards the pool surface.

Rear Concave Upforce Portion

In embodiments utilizing a rear concave upforce portion, the rear concave upforce portion is at a rear underside of the guiding member. The rear concave upforce portion is configured to produce a third force on the guided pool brush, at least a portion of which is substantially directed away from the pool surface, in response to a backward movement of the guided pool brush. On the bottom of a pool the third force tends to push the brush of the guided pool brush off of the bottom of the pool. On the sides of the pool the third force tends to push the guided pool brush off the side of the pool. The third force may enable and/or enhance proper brushing by allowing the guided pool brush to be easily moved in a backward movement during brushing. For instance the third force and second force may at least partially neutralize each other such that the guided pool brush stays near the pool surface during a backward movement of the guided pool brush but does not contact the pool surface or such that the guided pool brush contacts the pool surface but does not push down on the pool surface with substantial force during the backward movement. The second force and third force may therefore be substantially equal, or alternatively they can be unequal. For instance the second force may be larger than the third force or the third force may be larger than the second force.

The rear concave upforce portion comprises a concave shape. However the rear concave upforce portion may further comprise other shape characteristics within the concavity or on the edges of the rear concave upforce portion such as waviness, irregularities, patterns, bumps, ridges, raised portions, holes, jagged edges, straight edges, uneven edges, and anything else that may aid in producing the third force. The rear concave upforce portion may also comprise any of the aforementioned elements in order to achieve other results, such as holes or specific shapes used to reduce drag on the guided pool brush as it moves through the water.

The rear concave upforce portion may comprise any material or combination of materials including for example metal, polymer, ceramic, composite, wood, and so forth. The solidness of the rear concave upforce portion may range anywhere from completely solid to substantially hollow. The size of the rear concave upforce portion also may vary in order to fit to any size of brush. The rear concave upforce portion, brush, and any other elements or components could be fabricated together such that they are substantially one piece or such that they are multiple pieces that are joined during fabrication. In embodiments where the rear concave upforce portion is manufactured as a separate piece from the brush and/or other elements, the rear concave upforce portion may be coupled to or integrally joined with the brush and/or the other elements in any manner.

Rear Flat Upforce Portion

In embodiments utilizing a rear flat upforce portion, the rear flat upforce portion is at a rear underside of the guiding member. The rear flat upforce portion is configured to produce a fourth force on the guided pool brush, at least a portion of which is substantially directed away from the pool surface, in response to a backward movement of the guided pool brush. On the bottom of a pool the fourth force tends to push the guided pool brush off of the bottom of the pool. On the sides of the pool the fourth force tends to push the guided pool brush off the side of the pool. The fourth force may enable and/or enhance proper brushing by allowing the guided pool brush to be easily moved in a backward movement during brushing. For instance the fourth force, alone or in conjunction with the third force, may at least partially neutralize or cancel out the second force such that the guided pool brush stays near the pool surface during a backward movement of the guided pool brush but does not contact the pool surface or such that the guided pool brush contacts the pool surface but does not push down on the pool surface with substantial force during the backward movement. The second force may therefore by substantially equal to the fourth force, or substantially equal to the sum of the fourth force and the third force. Alternatively the second force may be greater than the fourth force, or greater than the third force, or greater than the sum of the third force and the third force. Alternatively the second force may be less than the fourth force, or less than the third force, or less than the sum of the third force and the fourth force.

The third force does not need to be present in order for the fourth force to be present. In other words in one embodiment the guiding member comprises a rear flat upforce portion but no rear concave upforce portion, the rear flat upforce portion produces a fourth force, but there is no third force present because there is no rear concave upforce portion. Thus the term "fourth" is only meant as a labeling means and is not meant to imply that the third force must be present in order for the fourth force to be present. Any combination of forces could be present in various embodiments—for instance one embodiment may include only the third force and not the first force, second force, or third force. In one embodiment the guiding member comprises a front concave downforce portion producing a first force, a rear concave downforce portion producing a second force, a rear concave upforce portion producing a third force, and a rear flat upforce portion producing a fourth force.

Furthermore, one or more pressures may be produced in response to one or more of the forces. For instance, during forward movement of the guided pool brush the brush of the guided pool brush may be maintained against the pool surface with a first pressure in response to the first force. The first pressure may be such that the brush brushes against the pool surface more effectively than it would without the first pressure. During backward movement of the guided pool brush a second pressure may be produced in response to the second force and the third force and/or the fourth force. The second pressure may be equal to or less than the first pressure in magnitude and may therefore either maintain the brush of the guided pool brush against the pool surface albeit with less pressure than during forward movement or with the same amount of pressure. The guided pool brush may alternatively be configured such that during backward movement the brush of the guided pool brush is maintained above the surface and therefore is not held down against the pool surface with a pressure.

The rear flat upforce portion comprises a substantially flat shape. However the rear flat upforce portion may further comprise other shape characteristics within the substantially flat portion or on the edges of the rear flat upforce portion such as waviness, irregularities, patterns, bumps, ridges, raised portions, holes, jagged edges, straight edges, uneven edges, and anything else that may aid in producing the fourth force. The rear flat upforce portion may also comprise any of the aforementioned elements in order to achieve other results, such as holes or specific shapes used to reduce drag on the guided pool brush as it moves through the water.

The rear flat upforce portion may comprise any material or combination of materials including for example metal, polymer, ceramic, composite, wood, and so forth. The solidness of the rear flat upforce portion may range anywhere from completely solid to substantially hollow. The size of the rear flat upforce portion also may vary in order to fit to any size of brush. The rear flat upforce portion, brush, and any other elements or components could be fabricated together such that they are substantially one piece or such that they are multiple pieces that are joined during fabrication. In embodiments where the rear flat upforce portion is manufactured as a separate piece from the brush and/or other elements, the rear flat upforce portion may be coupled to or integrally joined with the brush and/or the other elements in any manner.

Bullnose Portions and Tail Portion

In embodiments utilizing a front convex bullnose portion, the front convex bullnose portion is at a frontside of the guiding member. The front convex bullnose portion may be configured to enhance the flow of water in the vicinity of the guided pool brush so as to ease forward and/or backward movement of the guided pool brush.

In embodiments utilizing a top convex bullnose portion, the top convex bullnose portion is at a topside of the guiding member. The top convex bullnose portion may be configured to enhance the flow of water in the vicinity of the guided pool brush so as to ease forward and/or backward movement of the guided pool brush.

In embodiments utilizing a rear convex bullnose portion, the rear convex bullnose portion is at a rearside of the guiding member. The rear convex bullnose portion may be configured to enhance the flow of water in the vicinity of the guided pool brush so as to ease forward and/or backward movement of the guided pool brush.

In embodiments utilizing a rear tail portion, the rear tail portion extends rearward from the rearside of the guiding member. The rear tail portion may be configured to enhance the flow of water in the vicinity of the guided pool brush so as to ease forward and/or backward movement of the guided pool brush.

These elements and others will be understood more completely by the following examples of specific embodiments.

Embodiment 1

With reference to FIG. 1A-1C and FIG. 3 and for the exemplary purposes of this disclosure, guided pool brush 100 is an example of an implementation of a guided pool brush.

Guided pool brush 100 includes a brush 110 and a guiding member 120 coupled to or integrally joined with the brush. The guiding member comprises a front concave downforce portion 122 at a front topside of the guiding member, configured to produce a first force on the guided pool brush, at least a portion of which is substantially directed towards the pool surface, in response to a forward movement of the guided pool brush; a rear concave downforce portion 124 at a rear topside of the guiding member, configured to produce a second force on the guided pool brush, at least a portion of which is substantially directed towards the pool surface, in response to a backward movement of the guided pool brush; and a rear concave upforce portion 126 (shown in FIG. 3) at a rear underside of the guiding member, configured to produce a third force on the guided pool brush, at least a portion of which is substantially directed away from the pool surface, in response to the backward movement of the guided pool brush.

Figure 3:
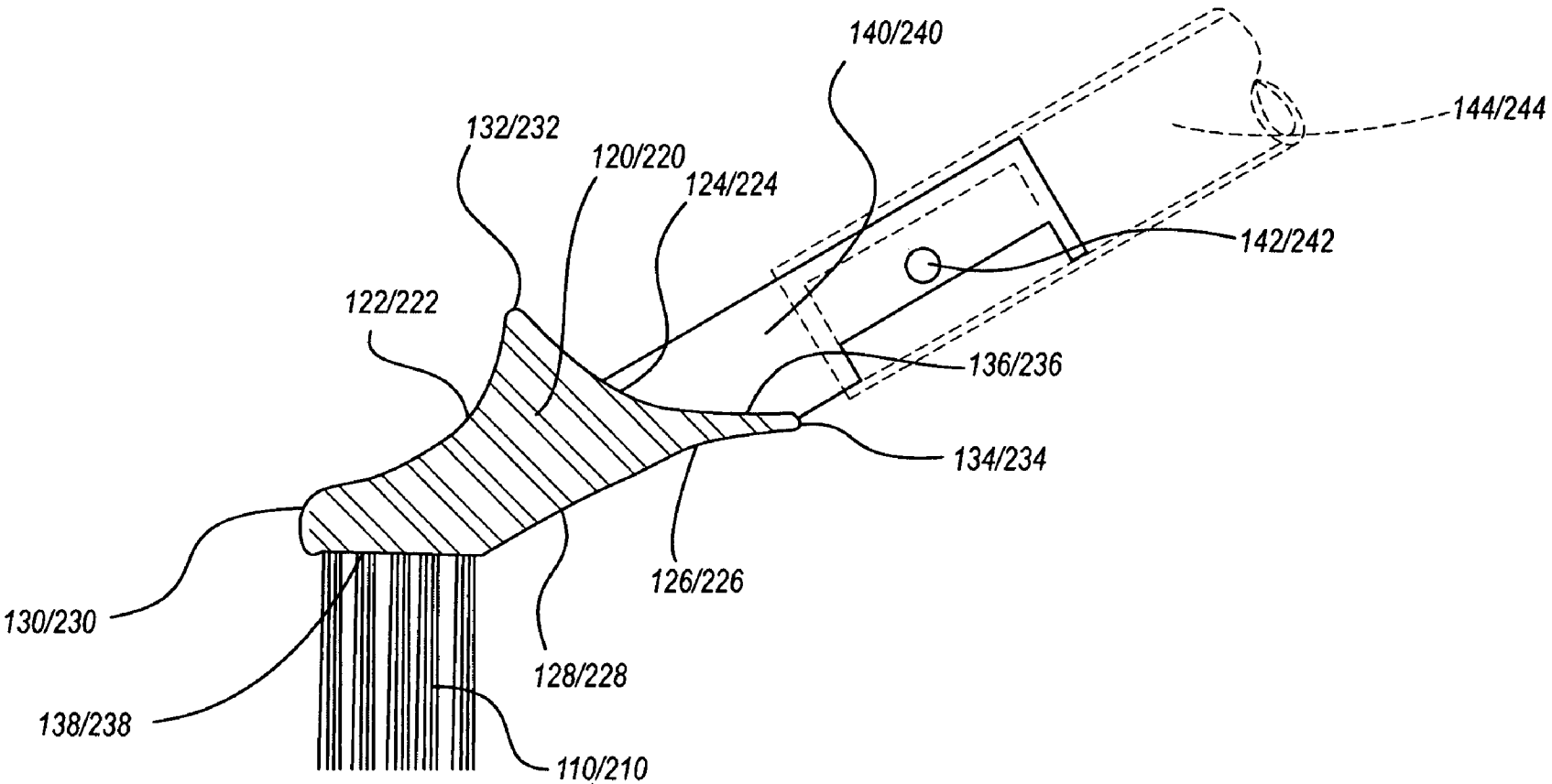
FIG. 3 is a cross section view of the guided pool brush of FIGS. 1C and 2C taken along line 3-3.

The front concave downforce portion may comprise a radius between about ¾ inch and about 1¾ inches. The front concave downforce portion may comprise a radius of about 1¼ inches. A circumference of the front concave downforce portion as seen in FIG. 3 may span between about 70 degrees to about 110 degrees. The circumference of the front concave downforce portion may span about 90 degrees.

The rear concave downforce portion may comprise a radius between about 1 inch and about 2 inches. The rear concave downforce portion may comprise a radius of about 1½ inches. A circumference of the rear concave downforce portion as seen in FIG. 3 may span between about 40 degrees and about 80 degrees. The circumference of the rear concave downforce portion may span about 60 degrees.

The guiding member may further comprise a rear tail portion 136 extending rearward from the rearside of the guiding member. The rear tail portion may comprise a length from a front of the rear tail portion to a back of the rear tail portion between about 9/32 inch and about ⅝ inch. The rear tail portion may comprise a length from the front of the rear tail portion to the back of the rear tail portion of about 9/16 inch. The rear tail portion may have a variable width from a top of the rear tail portion to a bottom of the rear tail portion. Alternatively, the rear tail portion may have a substantially constant width or a constant width from the top of the rear tail portion to the bottom of the rear tail portion. The rear tail portion may comprise an average width from the top of the rear tail portion to the bottom of the rear tail portion between about 3/64 inch and about 3/16 inch. The rear tail portion may comprise an average width from the top of the rear tail portion to the bottom of the rear tail portion of about 9/16 inch.

The rear concave upforce portion may comprise a radius between about 2 inches and about 3 inches. The rear concave upforce portion may comprise a radius of about 2½ inches. A circumference of the rear concave upforce portion as seen in FIG. 3 may span between about 10 degrees and about 50 degrees. The circumference of the rear concave upforce portion may span about 30 degrees.

The guiding member may further comprise a rear flat upforce portion 128 (shown in FIG. 3) at a rear underside of the guiding member, configured to produce a fourth force on the guided pool brush, at least a portion of which is substantially directed away from the pool surface, in response to the backward movement of the guided pool brush.

The guiding member may further comprise a front convex bullnose portion 130 at a frontside of the guiding member. The front convex bullnose portion may comprise a radius between about ¼ inch and about ¾ inch. The front convex bullnose portion may comprise a radius of about ½ inch. The front convex bullnose portion may be configured to enhance the flow of water in the vicinity of the guided pool brush so as to ease forward and/or backward movement of the guided pool brush. The front convex bullnose portion may comprise a height between about 7/32 inch and about ⅞ inch from a front flat brush interface portion 138 at a front underside of the guiding member to a top of the front convex bullnose portion. The front convex bullnose portion may comprise a height of about 7/16 inch from the front flat brush interface portion 138 at a front underside of the guiding member to the top of the front convex bullnose portion.

The guiding member may further comprise a top convex bullnose portion 132 at a topside of the guiding member. The top convex bullnose portion may comprise a diameter between about 1/32 inch and about ⅛ inch. The top convex bullnose portion may comprise a diameter of about 1/16 inch. The top convex bullnose portion may be configured to enhance the flow of water in the vicinity of the guided pool brush so as to ease forward and/or backward movement of the guided pool brush.

The guiding member may further comprise a rear convex bullnose portion 134 at a rearside of the guiding member. The rear convex bullnose portion may comprise a diameter between about 3/64 inch and about 3/16 inch. The rear convex bullnose portion may comprise a diameter of about 3/32 inch. The rear convex bullnose portion may be configured to enhance the flow of water in the vicinity of the guided pool brush so as to ease forward and/or backward movement of the guided pool brush.

A front flat brush interface portion 138 at a front underside of the guiding member may comprise a length from the front of the front flat brush interface portion to the rear of the front flat brush interface portion between about ½ inch and about 3 inches. The front flat brush interface portion 138 may comprise a length from the front of the front flat brush interface portion to the rear of the front flat brush interface portion of about 1¼ inches.

The brush 110 may comprise any width from a front of the brush to the rear of the brush. For instance the brush 110 may comprise a width from the front of the brush to the rear of the brush between about ½ inch and about 3 inches. The brush 110 may comprise a width from the front of the brush to the rear of the brush of just under 1¼ inches. The brush may comprise any height from a bottom of the brush to a top of the brush (or in other words to a front flat brush interface portion at the front underside of the guiding member). For instance the brush may comprise a height from the bottom of the brush to the top of the brush between about ½ inch and about 3 inches. The brush may comprise a height from the bottom of the brush to the top of the brush of about 1⅜ inches. The brush may comprise any material such as any metal (such as steel, aluminum, etc.), any plastic, any polymer, any composite, and so on.

The guiding member may comprise an arm 140 that couples to at least one of the guiding member and the brush. The arm may comprise any length, width, and, in the case of a hollow arm, any thickness. For instance the arm may comprise a length that is substantially long enough to allow the user to stand somewhere near the edge of the pool and still reach the bottom of the pool with the guided pool brush. The width of the arm may be between about ¾ inch and about 2 inches. The width of the arm may be about 1 1/16 inches. The arm may range from completely solid to substantially hollow and in embodiments where the arm is hollow the thickness of the arm may vary according to weight and strength considerations depending on the material being used. The arm may alternatively be a short connector allowing the arm to connect to a second arm 144. In such an embodiment the arm may comprise a coupling member 142 allowing it to couple to the second arm. The arm can comprise any material including but not limited to any metal (such as aluminum), any plastic, any polymer, wood, any composite, any ceramic, etc.

Embodiment 2

With reference to FIG. 2A-2C and FIG. 3 and for the exemplary purposes of this disclosure, guided pool brush 200 is an example of another implementation of a guided pool brush. Guided pool brush 200 includes a brush 210 and a guiding member 220 coupled to or integrally joined with the brush. The guiding member comprises a front concave downforce portion 222 at a front topside of the guiding member, configured to produce a first force on the guided pool brush, at least a portion of which is substantially directed towards the pool surface, in response to a forward movement of the guided pool brush; a rear concave downforce portion 224 at a rear topside of the guiding member, configured to produce a second force on the guided pool brush, at least a portion of which is substantially directed towards the pool surface, in response to a backward movement of the guided pool brush; and a rear concave upforce portion 226 (shown in FIG. 3) at a rear underside of the guiding member, configured to produce a third force on the guided pool brush, at least a portion of which is substantially directed away from the pool surface, in response to the backward movement of the guided pool brush.

The front concave downforce portion may comprise a radius between about ¾ inch and about 1¾ inches. The front concave downforce portion may comprise a radius of about 1¼ inches. A circumference of the front concave downforce portion as seen in FIG. 3 may span between about 70 degrees and about 110 degrees. The circumference of the front concave downforce portion may span about 90 degrees.

The rear concave downforce portion may comprise a radius between about 1 inch and about 2 inches. The rear concave downforce portion may comprise a radius of about 1½ inches. A circumference of the rear concave downforce portion as seen in FIG. 3 may span between about 40 degrees and about 80 degrees. The circumference of the rear concave downforce portion may span about 60 degrees.

The guiding member may further comprise a rear tail portion 236 extending rearward from a rearside of the guiding member. The rear tail portion may comprise a length from the front of the rear tail portion to the rear of the rear tail portion between about 9/32 inch and about ⅝ inch. The rear tail portion may comprise a length from the front of the rear tail portion to the rear of the rear tail portion of about 9/16 inch. The rear tail portion may vary in a width from a top of the rear tail portion to a bottom of the rear tail portion. Alternatively, the rear tail portion may comprise a substantially constant width or a constant width from the top of the rear tail portion to the bottom of the rear tail portion. The rear tail portion may comprise an average width from the top of the rear tail portion to the bottom of the rear tail portion between about 3/64 inch and about 3/16 inch. The rear tail portion may comprise an average width from the top of the rear tail portion to the bottom of the rear tail portion of about 9/16 inch.

The rear concave upforce portion may comprise a radius between about 2 inches and about 3 inches. The rear concave upforce portion may comprise a radius of about 2½ inches. A circumference of the rear concave upforce portion as seen in FIG. 3 may span between about 10 degrees and about 50 degrees. The circumference of the rear concave downforce portion may span about 30 degrees.

The guiding member may further comprise a rear flat upforce portion 228 (shown in FIG. 3) at a rear underside of the guiding member, configured to produce a fourth force on the guided pool brush, at least a portion of which is substantially directed away from the pool surface, in response to the backward movement of the guided pool brush.

The guiding member may further comprise a front convex bullnose portion 230 at a frontside of the guiding member. The front convex bullnose portion may comprise a radius between about ¼ inch and about ¾ inch. The front convex bullnose portion may comprise a radius of about ½ inch. The front convex bullnose portion may be configured to enhance the flow of water in the vicinity of the guided pool brush so as to ease forward and/or backward movement of the guided pool brush. The front convex bullnose portion may comprise a height between about 7/32 inch and about ⅞ inch from a front flat brush interface portion 238 at a front underside of the guiding member to a top of the front convex bullnose portion. The front convex bullnose portion may comprise a height of about 7/16 inch from the front flat brush interface portion 238 to the top of the front convex bullnose portion.

The guiding member may further comprise a top convex bullnose portion 232 at a topside of the guiding member. The top convex bullnose portion may comprise a diameter between about 1/32 inch and about ⅛ inch. The top convex bullnose portion may comprise a diameter of about 1/16 inch. The top convex bullnose portion may be configured to enhance the flow of water in the vicinity of the guided pool brush so as to ease forward and/or backward movement of the guided pool brush.

The guiding member may further comprise a rear convex bullnose portion 234 at a rearside of the guiding member. The rear convex bullnose portion may comprise a diameter between about 3/64 inch and about 3/16 inch. The rear convex bullnose portion may comprise a diameter of about 3/32 inch. The rear convex bullnose portion may be configured to enhance the flow of water in the vicinity of the guided pool brush so as to ease forward and/or backward movement of the guided pool brush.

A front flat brush interface portion 238 at a front underside of the guiding member may comprise a length from the front of the front flat brush interface portion 238 to the rear of the front flat brush interface portion between about ½ inch and about 3 inches. The front flat brush interface portion 238 may comprise a length from the front of the front flat brush interface portion to the rear of the front flat brush interface portion of about 1¼ inches.

The brush 210 may comprise any width from a front of the brush to the rear of the brush. For instance the brush 210 may comprise a width from the front of the brush to the rear of the brush between about ½ inch and about 3 inches. The brush 210 may comprise a width from the front of the brush to the rear of the brush of just under 1¼ inches. The brush may comprise any height from a bottom of the brush to a top of the brush (or in other words to a front flat brush interface portion at the front underside of the guiding member). For instance the brush may comprise a height from the bottom of the brush to the top of the brush between about ½ inch and about 3 inches. The brush may comprise a height from the bottom of the brush to the top of the brush of about 1⅜ inches. The brush may comprise any material such as any metal (such as steel, aluminum, etc.), any plastic, any polymer, any composite, and so on.

The guiding member may comprise an arm 240 that couples to at least one of the guiding member and the brush. The arm may comprise any length, width, and, in the case of a hollow arm, any thickness. For instance the arm may comprise a length that is substantially long enough to allow the user to stand somewhere near the edge of the pool and still reach the bottom of the pool with the guided pool brush. The width of the arm may be between about ¾ inch and about 2 inches. The width of the arm may be about 1 1/16 inches. The arm may range from completely solid to substantially hollow and in embodiments where the arm is hollow the thickness of the arm may vary according to weight and strength considerations depending on the material being used. The arm may alternatively be a short connector allowing the arm to connect to a second arm 244. In such an embodiment the arm may comprise a coupling member 242 allowing it to couple to the second arm. The arm can comprise any material including but not limited to any metal (such as aluminum), any plastic, any polymer, wood, any composite, any ceramic, etc.

Figure 2A:
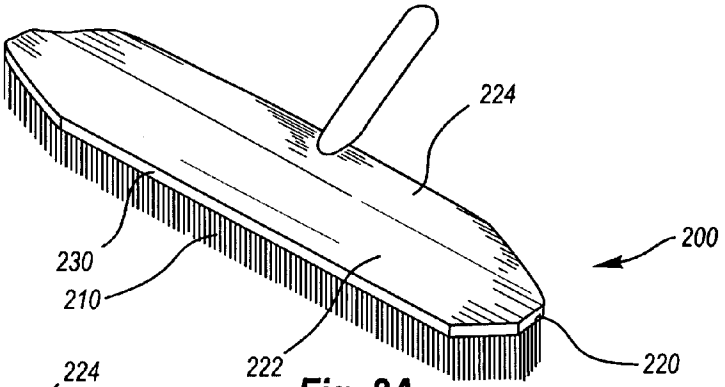
FIG. 2A is a perspective view of another implementation of a guided pool brush.
Figure 2B:
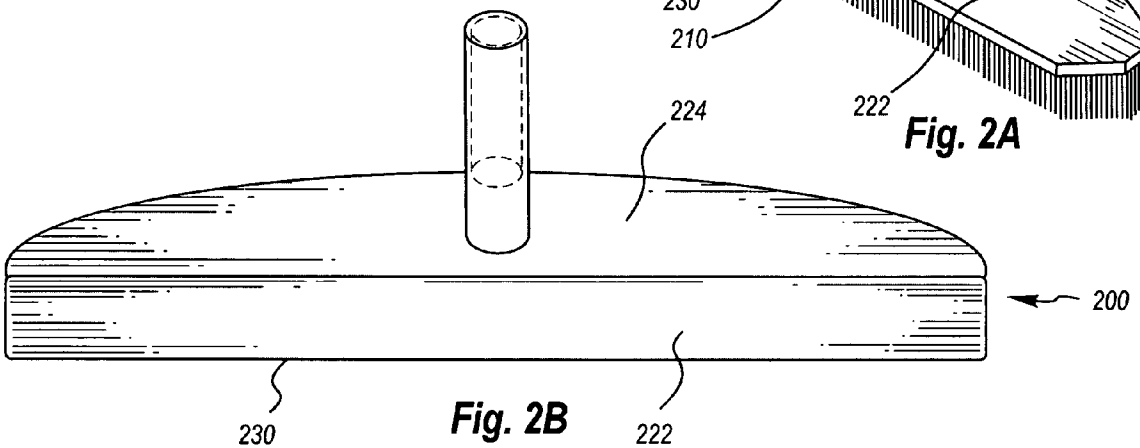
FIG. 2B is a top view of the guided pool brush in FIG. 2A.
Figure 2C:
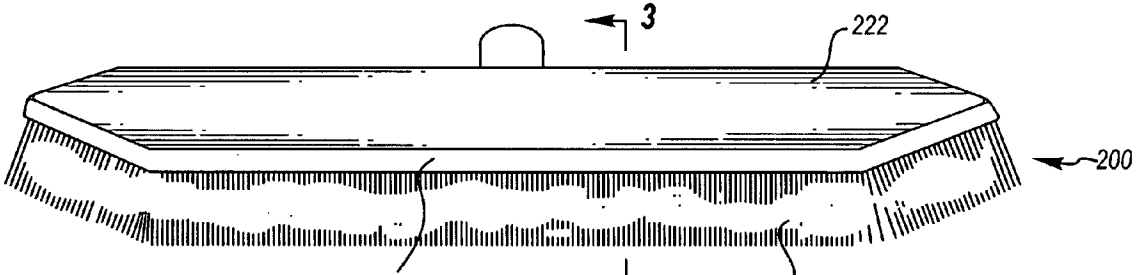
FIG. 2C is a front view of the guided pool brush in FIG. 2A.

Guided pool brush 200 differs from guided pool brush 100 in that guided pool brush 200 is angled upwards on the edges, as can be seen in FIG. 2A and FIG. 2C. This allows the guided pool brush to more easily brush rounded portions of a pool surface such as where the sides of a pool meet the bottom of a pool. Although guided pool brush 200 and guided pool brush 100 differ on their edges, they are otherwise similar. Hence they have the same side cross section view as depicted in FIG. 3, as FIG. 3 is a cross section the guided pool brush that is not near the edges but is nearer the center of the guided pool brush.

Embodiment 3

Figure 4A:
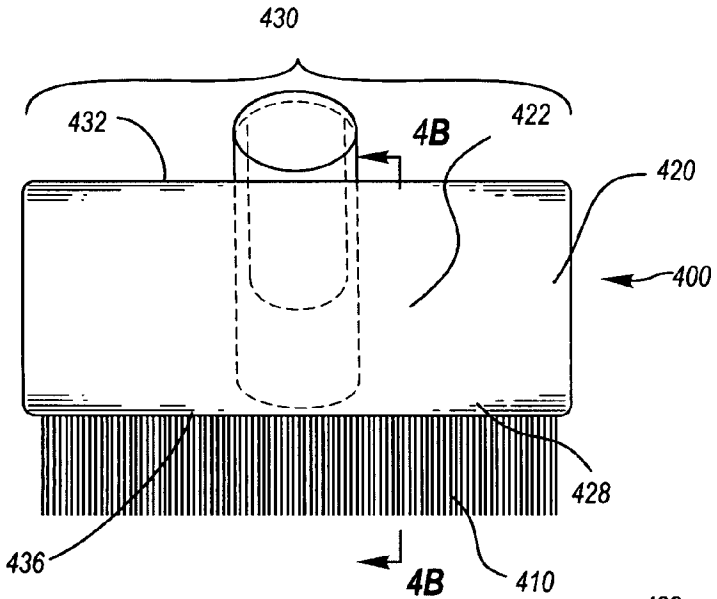
FIG. 4A is a front view of another implementation of a guided pool brush.
Figure 4B:
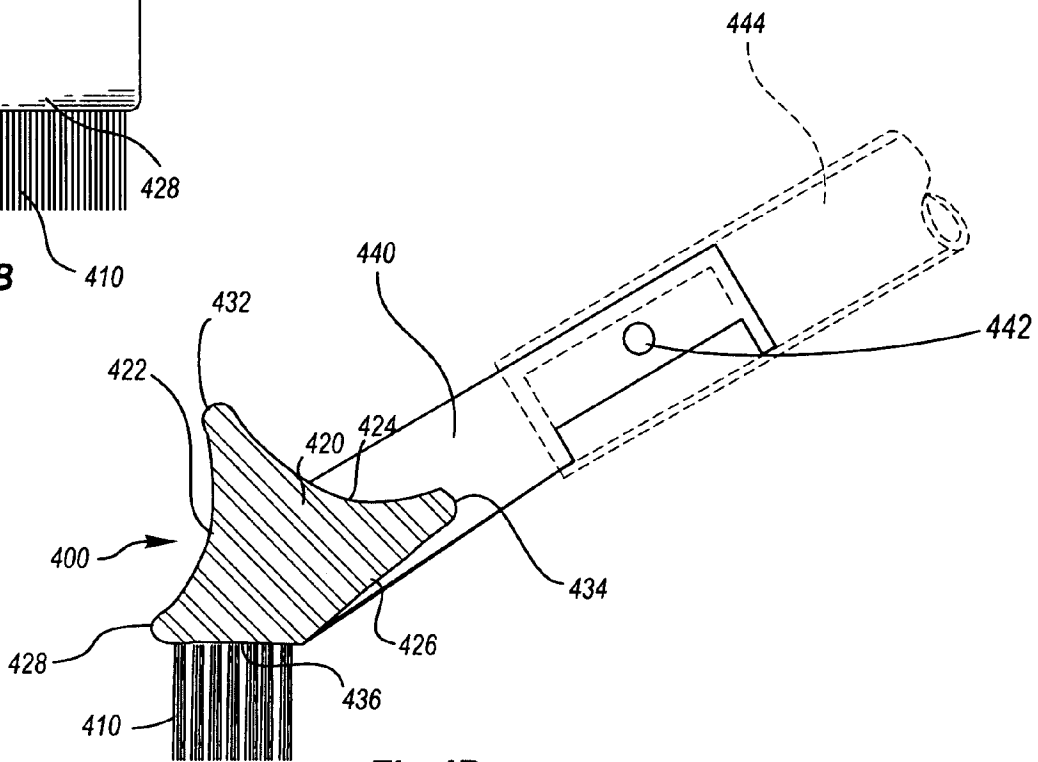
FIG. 4B is a cross section view of the guided pool brush in FIG. 4A taken along line 4B-4B.

With reference to FIG. 4A-4B and for the exemplary purposes of this disclosure, guided pool brush 400 is another example of an implementation of a guided pool brush. Guided pool brush 400 comprises: a brush 410; and a guiding member 420 coupled to or integrally joined with the brush, comprising a front concave downforce portion 422 at a front topside of the guiding member, configured to produce a first force on the guided pool brush, at least a portion of which is substantially directed towards the pool surface, in response to a forward movement of the guided pool brush; a rear concave downforce portion 424 at a rear topside of the guiding member, configured to produce a second force on the guided pool brush, at least a portion of which is substantially directed towards the pool surface, in response to a backward movement of the guided pool brush; and a rear flat upforce portion 426 at a rear underside of the guiding member, configured to produce a fourth force on the guided pool brush, at least a portion of which is substantially directed away from the pool surface, in response to the backward movement of the guided pool brush.

The rear flat upforce portion may be angled at an angle between about 20 degrees and about 50 degrees with respect to the front flat brush interface portion 436 of the guiding member.

The front concave downforce portion may comprise a radius between about 1 inch and about 2 inches. The front concave downforce portion may comprise a radius of about 1½ inches. A circumference of the front concave downforce portion as seen in FIG. 4B may span between about 70 degrees to about 110 degrees. The circumference of the front concave downforce portion may span about 90 degrees.

The rear concave downforce portion may comprise a radius between about 1 inch and about 2 inches. The rear concave downforce portion may comprise a radius of about 1½ inches. A circumference of the rear concave downforce portion as seen in FIG. 4B may span between about 70 degrees to about 110 degrees. The circumference of the rear concave downforce portion may span about 90 degrees.

The guiding member may further comprise a front convex bullnose portion 428 at a frontside of the guiding member. The front convex bullnose portion may comprise a diameter smaller than about 7/16 inch. The front convex bullnose portion may be configured to enhance the flow of water in the vicinity of the guided pool brush so as to ease forward and/or backward movement of the guided pool brush.

The guided pool brush 400 may comprise an algae brush. The guided pool brush 400 may comprise a length 430. The length 430 may be between about 4 inches and about 6 inches. The length 430 may be about 5 inches.

The guided pool brush 400 may further comprise a top convex bullnose portion 432, at a topside of the guiding member. The top convex bullnose portion may comprise a radius between about 1/16 inch and about ¼ inch. The top convex bullnose portion may comprise a radius of about ⅛ inch. The top convex bullnose portion may be angled at an angle between about 50 degrees and about 70 degrees with respect to the front flat brush interface portion 436 of the guiding member and angled towards the frontside of the guiding member. The top convex bullnose portion may be angled at an angle of about 60 degrees with respect to the front flat brush interface portion 436 of the guiding member and angled towards the frontside of the guiding member. The top convex bullnose portion may be configured to enhance the flow of water in the vicinity of the guided pool brush so as to ease forward and/or backward movement of the guided pool brush.

The guided pool brush 400 may further comprise a rear convex bullnose portion 434, at a rearside of the guiding member. The rear convex bullnose portion may be configured to enhance the flow of water in the vicinity of the guided pool brush so as to ease forward and/or backward movement of the guided pool brush.

The brush 410 may comprise any width from a front of the brush to the rear of the brush. The brush may comprise any height from a bottom of the brush to a top of the brush (or in other words to the front flat brush interface portion). For instance the brush may comprise a height from the bottom of the brush to the top of the brush between about ¼ inch and about 2 inches. The brush may comprise a height from the bottom of the brush to the top of the brush of about 1 inch. The brush may comprise any material such as any metal (such as steel, aluminum, etc.), any plastic, any polymer, any composite, and so on.

The guiding member may comprise an arm 440 that couples to at least one of the guiding member and the brush. The arm may comprise any length, width, and, in the case of a hollow arm, any thickness. For instance the arm may comprise a length that is substantially long enough to allow the user to stand somewhere near the edge of the pool and still reach the bottom of the pool with the guided pool brush. The arm may range from completely solid to substantially hollow and in embodiments where the arm is hollow the thickness of the arm may vary according to weight and strength considerations depending on the material being used. The arm may alternatively be a short connector allowing the arm to connect to a second arm 444. In such an embodiment the arm may comprise a coupling member 442 allowing it to couple to the second arm. The arm can comprise any material including but not limited to any metal (such as aluminum), any plastic, any polymer, wood, any composite, any ceramic, etc.

Other Implementations

Many additional implementations are possible. Further implementations are within the CLAIMS.

Specifications, Materials, Manufacture, Assembly and Installation

The guiding member may comprise one piece, substantially one piece, or two or more separate pieces. If it comprises two or more pieces the two pieces may be coupled or joined together in any manner such as gluing, heat diffusion bonding, clamping, screwing, taping, friction bonding, pressure, and so on. The guiding member and brush may comprise one piece, substantially one piece, or two or more pieces. If they comprise two or more pieces they may be joined or coupled together in any manner such as gluing, heat diffusion bonding, clamping, screwing, taping, friction bonding, pressure, and so on. Likewise, the guiding member, brush, and arm may comprise substantially one piece, or they may comprise two or more pieces. If they comprise two or more pieces they may be joined or coupled together in any manner such as gluing, heat diffusion bonding, clamping, screwing, taping, friction bonding, pressure, and so on.

It will be understood that implementations are not limited to the specific components disclosed herein, as virtually any components consistent with the intended operation of a method and/or system implementation for a guided pool brush may be utilized. Accordingly, for example, although particular components of a brush and a guiding member are disclosed, such components may comprise any shape, size, style, type, model, version, class, grade, measurement, concentration, material, weight, quantity, and/or the like consistent with the intended operation of a method and/or system implementation for a guided pool brush. Implementations are not limited to uses of any specific components, provided that the components selected are consistent with the intended operation of a method and/or system implementation for a guided pool brush.

Accordingly, the components defining any guided pool brush implementation may be formed of any of many different types of materials or combinations thereof that can readily be formed into shaped objects provided that the components selected are consistent with the intended operation of a guided pool brush implementation. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any guided pool brush implementation may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive (e.g. epoxy), a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Use

Implementations are particularly useful in cleaning a pool. However, implementations are not limited to uses relating to cleaning a pool. Rather, any description relating to cleaning a pool is for the exemplary purposes of this disclosure, and implementations may also be used in a variety of applications with similar results for a variety of cleaning purposes, such as cleaning any underwater surface such as a pond surface, a tub, and the like.

In describing the use of implementations, with reference to FIGS. 1A-3 and for the exemplary purposes of this disclosure, one method of cleaning a pool comprises: providing a brush; providing a guiding member coupled to or integrally joined with the brush, wherein the guiding member comprises: a front concave downforce portion at a front topside of the guiding member, configured to produce a first force on the guided pool brush, at least a portion of which is substantially directed towards the pool surface, in response to a forward movement of the guided pool brush; a rear concave downforce portion at a rear topside of the guiding member, configured to produce a second force on the guided pool brush, at least a portion of which is substantially directed towards the pool surface, in response to a backward movement of the guided pool brush; and a rear concave upforce portion at a rear underside of the guiding member, configured to produce a third force on the guided pool brush, at least a portion of which is substantially directed away from the pool surface, in response to the backward movement of the guided pool brush; and alternately moving the guided pool brush in a forward movement on the surface of the pool and moving the guided pool brush in a backward movement. In this implementation the step of providing a guiding member may further comprise: the front concave downforce portion comprises a radius of about 1¼ inches; the rear concave downforce portion comprises a radius of about 1½ inches; and the rear concave upforce portion comprises a radius of about 2½ inches.

With reference to FIGS. 4A-4B and for the exemplary purposes of this disclosure, another method of cleaning a pool comprises: providing a brush; providing a guiding member coupled to or integrally joined with the brush, wherein the guiding member comprises: a front concave downforce portion at a front topside of the guiding member, configured to produce a first force on the guided pool brush, at least a portion of which is substantially directed towards the pool surface, in response to a forward movement of the guided pool brush; a rear concave downforce portion at a rear topside of the guiding member, configured to produce a second force on the guided pool brush, at least a portion of which is substantially directed towards the pool surface, in response to a backward movement of the guided pool brush; and a rear flat upforce portion at a rear underside of the guiding member, configured to produce a fourth force on the guided pool brush, at least a portion of which is substantially directed away from the pool surface, in response to the backward movement of the guided pool brush; and alternately moving the guided pool brush in a forward movement on the surface of the pool and moving the guided pool brush in a backward movement. In this implementation the step of providing a guiding member may further comprise: the front concave downforce portion comprises a radius of about 1½ inches; and the rear concave downforce portion comprises a radius of about 1½ inches.

While the description above refers to particular implementations and related methods for a guided pool brush, it should be readily apparent to people of ordinary skill in the art that a number of modifications may be made without departing from the spirit thereof. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A guided pool brush, comprising:

a brush; and a guiding member comprising:

a rectangular first side coupled to or integrally joined with the brush;

a concave second side adjacent to the first side, the concave second side positioned such that a forward movement of the guided pool brush in a pool produces a first force on the guided pool brush, wherein at least a portion of the first force is directed towards the pool surface;

a concave third side adjacent to the second side and opposite the first side, the concave third side positioned such that a backward movement of the guided pool brush in the pool produces a second force on the guided pool brush, wherein at least a portion of the second force is directed towards the pool surface; and a fourth side adjacent to the third sides and opposite the second side, the fourth side positioned such that the backward movement of the guided pool brush in the pool produces a third force on the guided pool brush, wherein at least a portion of the third force is directed away from the pool surface.

2. A guided pool brush according to claim 1, wherein the concave second side comprises a radius between about ¾ inch and about 1 ¾ inches.

3. A guided pool brush according to claim 1, wherein the concave third side comprises a radius between about 1 inch and about 2 inches.

4. The guided pool brush according to claim 1, wherein a plane formed tangent to the concave second side forms an acute angle with the first side.

5. The guided pool brush according to claim 1, wherein corners formed by intersection of the first side and concave second side, the concave second side and the concave third side, and the concave third side and the fourth side all comprise rounded corners.

6. A guided pool brush according to claim 1, wherein the fourth side comprises a concave fourth side.

7. A guided pool brush according to claim 6, wherein the concave fourth side comprises a radius between about 2 inches and about 3 inches.

8. A guided pool brush according to claim 1, wherein the the first side comprises a front flat brush interface and further comprising a flat fifth side between the concave fourth side and the first side, the flat fifth side positioned such that the backward movement of the guided pool brush in the pool produces a fourth force on the guided pool brush, wherein at least a portion of the fourth force is directed away from the pool surface.

9. The guided pool brush according to claim 8, wherein the flat fifth side and the first side form an obtuse angle.

10. A guided pool brush according to claim 1, wherein intersection of the first side and the concave second side comprises a front convex bullnose portion.

11. A guided pool brush according to claim 10, wherein the front convex bullnose portion comprises a radius between about ¼ inch and about ¾ inch.

12. A guided pool brush according to claim 11, wherein the front convex bullnose portion comprises a radius of about ½ inch.

13. A guided pool brush, comprising:

a brush; and a guiding member coupled to or integrally joined with the brush at a bottom side, comprising:

a concave front portion adjacent to the bottom side, the concave front portion configured such that a forward movement of the guided pool brush in a pool produces a first force on the guided pool brush, at least a portion of which is directed towards the pool surface a concave top portion adjacent to the front concave portion, the concave top portion configured such that a backward movement of the guided pool brush in the pool produces a second force on the guided pool brush, at least a portion of which is directed towards the pool surface; and a flat rear portion adjacent to the brush, the flat rear portion forming an obtuse angle with the bottom side and configured such that the backward movement of the guided pool brush in the pool produces a fourth force on the guided pool brush, at least a portion of which is directed away from the pool surface.

14. A guided pool brush according to claim 13 wherein the concave front portion comprises a radius between about ¾ inches and about 1¾ inches.

15. A guided pool brush according to claim 14 wherein the concave front portion comprises a radius of 1½ inches.

16. A guided pool brush according to claim 13 wherein the concave rear portion comprises a radius between about 1 inch and about 2 inches.

17. A guided pool brush according to claim 13 wherein the guiding member further comprises a front convex bullnose portion at a frontside of the guiding member.

18. A guided pool brush according to claim 13, wherein the guiding member further comprises a top convex bullnose portion at a topside of the guiding member, the top convex bullnose portion comprising a radius between about 1/16 inch and about ½ inch.

19. A method of cleaning a pool surface, comprising:

pushing a guided pool brush in a forward movement proximate a pool surface, the forward movement producing a first force on the guided pool brush at a front concave portion at a front topside of a guiding member of the guided pool brush, wherein at least a portion of the first force is directed towards the pool surface, thereby maintaining a brush of the guided pool brush against the pool surface with a first pressure in response to the first force;

pulling the guided pool brush in a backward movement proximate the pool surface, the backward movement producing a second force on the guided pool brush at a rear concave portion at a rear topside of the guiding member of the guided pool brush, wherein at least a portion of the second force is directed towards the pool surface the backward movement further producing a fourth force on the guided pool brush at a rear flat portion at a rear underside of the guiding member of the guided pool brush, wherein at least a portion of the fourth force is directed away from the pool surface; and maintaining the brush of the guided pool brush in at least one of above the pool surface and against the pool surface with a second pressure in response to the second force and the fourth force, the second pressure being one of less than or equal to the first pressure.

20. The method of claim 19, wherein the pulling the guided pool brush in a backward movement further comprises producing a third force on the guided pool brush at a rear concave portion at a rear underside of the guiding member of the guided pool, wherein at least a portion of the third force is directed away from the pool surface; and wherein the step of maintaining the brush of the guided pool brush against the pool surface with a second pressure comprises maintaining the brush of the guided pool brush against the pool surface with a second pressure in response to the second force, the third force, and the fourth force, the second pressure being one of less than the first pressure and equal to the first pressure.

* * * * *